United States Patent [19]

Isobe et al.

[11] Patent Number: 4,848,127

[45] Date of Patent: Jul. 18, 1989

[54] METHOD OF REDUCING SLAB IN WIDTHWISE DIRECTION

[75] Inventors: Kunio Isobe; Takaaki Hira, both of Chiba; Takayuki Naoi, Kurashiki; Hideyuki Nikaido, Kurashiki; Kozo Fujiwara, Kurashiki; Shigeru Ueki, Kurashiki; Kouzou Ishikawa, Kurashiki; Toshihiro Hanada, Kurashiki, all of Japan

[73] Assignee: Kawasaki Steel Corporation, Kobe, Japan

[21] Appl. No.: 113,531

[22] Filed: Oct. 27, 1987

[30] Foreign Application Priority Data

Dec. 1, 1986 [JP] Japan ..... 61-284265

[51] Int. Cl.[4] ..... B21B 1/02

[52] U.S. Cl. ..... 72/206; 72/235

[58] Field of Search ..... 72/206, 234, 235, 365, 72/366, 14, 16, 240

[56] References Cited

U.S. PATENT DOCUMENTS

| | | | |
|---|---|---|---|
| 4,532,789 | 8/1985 | Bruinsma et al. | 72/235 |
| 4,587,823 | 5/1986 | Eibe | 72/206 |
| 4,651,550 | 3/1987 | Nihei et al. | 72/206 X |
| 4,672,830 | 6/1987 | Tsukamoto et al. | 72/235 X |

FOREIGN PATENT DOCUMENTS

| | | |
|---|---|---|
| 0157575 | 10/1985 | European Pat. Off. . |
| 59-101201 | 12/1982 | Japan . |
| 60-203302 | 10/1985 | Japan . |
| 61-135401 | 6/1986 | Japan . |
| 61-135402 | 6/1986 | Japan . |

OTHER PUBLICATIONS

Patent Abstracts of Japan, vol. 8, No. 216(M-329)[1563] Oct. 3, 1984; & JP-A-59 101 201 (Hitachi) 11-06-1984.

Patent Abstracts of Japan, vol. 10, No. 331(M-533)[2387] Nov. 11, 1986; & JP-A-61 135 402 (Kawasaki) 06-23-86.

Patent Abstracts of Japan, vol. 10, No. 286(M-521)[2342] Sep. 27, 1986; JP-A-61 103 601 (Kawasaki) 05-22-1986.

*Primary Examiner*—Lowell A. Larson

*Assistant Examiner*—Steven B. Katz

*Attorney, Agent, or Firm*—Balogh, Osann, Kramer, Dvorak, Genova, & Traub

[57] ABSTRACT

A slab is successively fed between periodically moving press tools to reduce the slab in a widthwise direction. In this method, the leading and tail end portions of a given length in the slab are reduced at a reduced width wider than that of remaining steady portion.

1 Claim, 5 Drawing Sheets

Leading and Tail Ends

Steady Portion

METHOD OF REDUCING SLAB IN WIDTHWISE DIRECTION

BACKGROUND OF THE INVENTION

1. Field of the Invention

The integration of slab width has a remarkable merit in energy-saving based on the intensification of continuously casting molds in the continuous casting operation and the shortening of steps. Recently, the continuous casting is synchronized with a hot strip mill by unifying widths of continuously cast slabs.

In order to unify the slab width, it is necessary that the width of the slab can largely be reduced up to a minimum product width at a hot rough rolling process as a preliminary step. A method of reducing slab width, which satisfies the above requirement, will be described below.

2. Related Art Statement

There is known a method of largely reducing slab width through a large-size roll or large-size caliber roll, which has been developed from the conventional width reducing method through a vertical roll mill as a width reducing adjustment.

In this method, however, the slab is largely reduced by the roll, so that metal flows particularly at the leading and tail ends of the width-reduced slab toward these leading and tail ends, and consequently a so-called crop largely grows to extremely degrade the yield.

On the other hand, Japanese Patent laid open No. 59-101,201 has proposed a continuously widthwise pressing, wherein a slab is fed between a pair of press tools approaching to and separating from each other at a predetermined minimum opening to gradually reduce the width of the slab between the slant portions of the press tools and make the slab to a given slab width between the parallel portions of the press tools. Particularly, Japanese Patent laid open No. 61-135,402 discloses that in order to minimize the leading end crop, the quantity of the leading end portion of the slab fed between the press tools is larger than the quantity of the steady portion, and in order to prevent the dull deformation of the slab at its leading end shoulder, the leading end portion of 50~100 mm in length is wider than the width of the steady portion.

When the thus treated slab is rolled to produce a hot strip coil, the dull deformation of the shoulder portion is prevented and the crop loss becomes small, but there is caused another problem that the strip width is largely shortened at a position located inward from the leading end. Such a narrow width portion is particularly large at the leading end side and also may be caused at the tail end side, which is cut out as a width shortage to largely reduce the yield.

SUMMARY OF THE INVENTION

It is an object of the invention to provide a method of reducing a slab in widthwise direction through a press for producing a hot strip coil having a good width accuracy over a whole length in longitudinal direction of the coil which effectively prevents the rapid shortening of coil width caused at the most leading end and the slight tail end portion of the hot strip coil produced by rolling the slab having a width reduced through the press tools and further the width shortage liable to be caused at the tail end.

According to the invention, there is the provision of a method of reducing a slab in widthwise direction by successively feeding the slab between a pair of press tools periodically approaching to and separating away from each other at a given space to gradually reduce the slab width, characterized in that leading and/or tail end portions of the slab over a length of 150~2,000 mm are worked at a reduced width wider than that set at a steady portion of the slab except for these end portions and in accordance with a difference in width returned quantity between the end portion and the steady portion in subsequent flat pass rolling.

In practice, the end portion of the slab having a width wider than that of the steady portion by mitigation of width reducing quantity is made longer at the leading end side of the slab rather than at the tail end side, and the difference of the reduced width $\delta$ is usually not more than 70 mm and properly selected in accordance with the size of the slab.

BRIEF DESCRIPTION OF THE DRAWINGS

The invention will be described with reference to the accompanying drawings, wherein.

DESCRIPTION OF THE PREFERRED EMBODIMENTS

Figure 1:
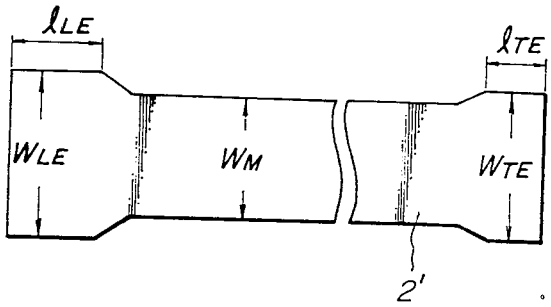
FIG. 1 is a plan view of an embodiment of the width-adjusted slab according to the invention.

In FIG. 1 is shown a flat shape of a width-adjusted slab 2' obtained by reducing the slab in widthwise direction according to the invention, wherein $l_{LE}$, $l_{TE}$ are lengths of leading and tail end portions from the leading and tail ends of the slab, respectively, and $W_{LE}$, $W_{TE}$ are slab widths at the same end portions, and $W_M$ is a slab width at a steady portion.

The reducing of the slab in widthwise direction will be described in the order of steps in FIG. 2.

In FIG. 2, numeral 1 is a pair of press tools, and numeral 2 is a slab at a reduced state in widthwise direction.

Figure 2A:
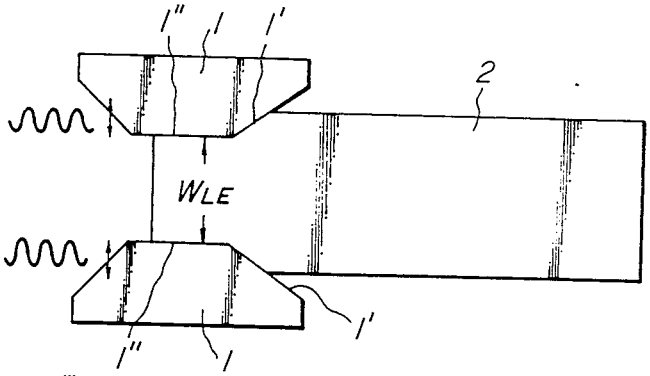
FIGS. 2*a* to 2*d* are diagrammatical views showing steps for reducing the slab in widthwise direction according to the invention, respectively.
Figure 2B:
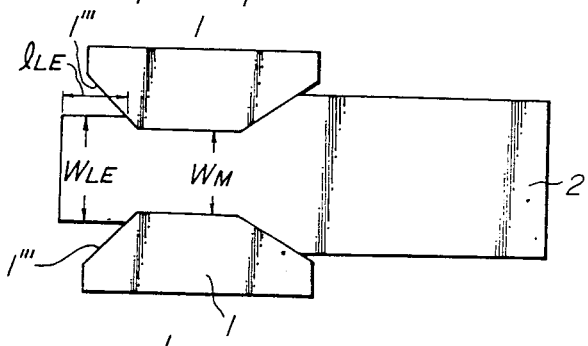
Figure 2C:
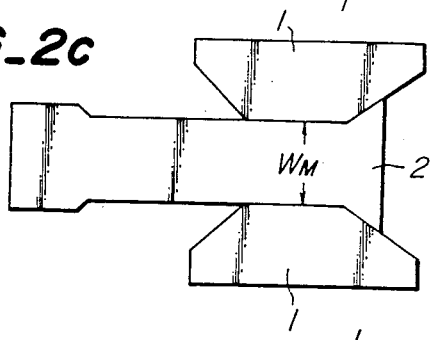
Figure 2D:
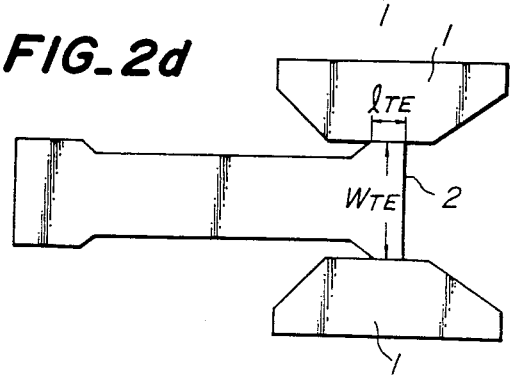

By successively feeding the slab 2 between the press tools 1, 1 driven to periodically repeat the approach and separation, the width of the slab 2 is reduced to a slab width $W_{LE}$ set by a minimum opening between parallel portions 1'' and 1'' defined among slant portions 1', 1' and parallel portions 1'', 1'' at the entrance side of the press tools 1, 1 as shown in FIG. 2*a*. Then, when the leading end portion of the slab goes forward from the slant portions 1''', 1''' at the delivery side of the press tools 1, 1 to only a distance $l_{LE}$ as shown in FIG. 2*b*, the minimum opening between the press tools 1, 1 is further narrowed to a value corresponding to a reduced width $W_M$ to perform the width reducing of the steady portion of the slab. When the tail end portion of the slab 2 approaches to the slant portions 1', 1' at the entrance side of the press tools 1, 1 as shown in FIG. 2*c*, the minimum opening is again widened to a value $W_{TE}$ as shown in FIG. 2*d* to reduce the tail end portion in widthwise direction. In this case, the length of the width-reduced tail end portion is $l_{TE}$.

In this way, there can be obtained the width-adjusted slab 2' wherein the widths of the end portions Shown by leading and tail end lengths $l_{LE}$, $l_{TE}$ are wider than the width of the steady portion as shown in FIG. 1.

Figure 4:
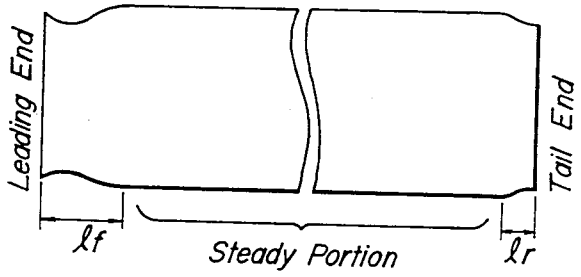
FIG. 4 is a schematical view showing a plan shape of the slab when being subjected to a flat pass rolling after the pressing.

When the slab is pressed from the leading end to the tail end at the same minimum opening of tools (conventional press process) and then rolled to a thickness approximately equal to or lower than the thickness of the original slab, the leading and tail end portions of the slab have a plan shape as schematically shown in FIG. 4. That is, the leading and tail end portions of lengths $l_f$ and $l_r$ are narrower in the width than the steady portion. If such a slab is rolled into a coil, the lengths $l_f$ and $l_r$ are further lengthened with the reduction of the thickness, resulting in a large yield loss.

Figure 5A:
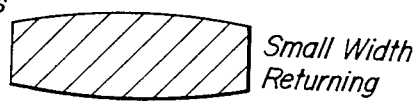
FIG. 5*a* and 5*b* are transverse sectional views of the slab after the pressing.
Figure 5B:
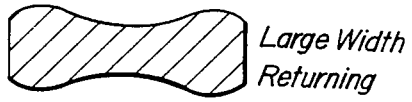

The mechanism on such a width shortage at leading and tail ends is considered as follows. That is, the sectional shapes in widthwise direction of the leading and tail end portions and the steady portion after the pressing are different as shown in FIGS. 5*a* and 5*b*. The leading and tail end portions are liable to flow metal in the lengthwise direction, so that they indicate a single bulging form wherein the widthwise central portion is relatively thick. On the other hand, the steady portion restrains the flowing of metal in the lengthwise direction and indicates a double bulging form wherein both side ends are thick. When this slab is subjected to a flat pass rolling, portions having a relatively thick thickness are strongly rolled, during which metal moves in the lengthwise direction and the widthwise direction. In this case, the steady portion hardly moves metal in the lengthwise direction, so that metal is easy to flow in the widthwise direction as compared with the leading and tail end portions. Furthermore, the thicker portion of the steady portion is both side ends thereof, so that the width returning is facilitated. From this reason is caused a phenomenon that the width of the steady portion becomes wider, and in other words, the widths of the leading and tail ends become relatively narrow.

Therefore, it is important to make the width of the pressed slab at the leading and tail ends wider in accordance with estimate quantities of width returning at the leading and tail ends and steady portion. For this purpose, it is necessary to determine the quantity ($\delta$) and lengths ($l_{LE}$, $l_{TE}$) of the leading and tail end portions to be pressed as compared with those of the steady portion.

The term "quantity ($\delta$)" used herein means a width reducing variation quantity corresponding to $W_{LE}-W_M$ of FIG. 2*b* in case of the leading end portion or $W_{TE}-W_M$ of FIG. 2*d* in case of the tail end portion.

The settlement of $\delta$ is based on the estimation of width returning quantity of the steady portion when the slab is subjected to flat pass rolling after the pressing ($\Delta W_o=W_o-W_M$, wherein $W_o$ is a width after flat pass rolling, and $W_M$ is a width of slab after the pressing). $\Delta W_o$ is determined in relation to size of slab before the pressing (thickness H, width W), width of slab after the pressing ($W_M$) and flat pass rolling conditions (roll diameter D, draft r). That is, $\Delta W_o$ is represented by the following equation:

$$\Delta W_o=f(H, W, W_M, D, r) \quad (1)$$

The term "$\Delta W_o$" is a width returning quantity of the steady portion in the slab having a sectional shape of FIG. 5*b* through flat pass rolling. If the leading end portion and the tail end portion if FIG. 5*a* are width-returned only by the same $\Delta W_o$, there is caused no problem. However, the width returning quantity of each of the leading end and tail end portions is smaller than $\Delta W_o$ as mentioned above. Therefore, it is important that the width of each of the leading end and tail end portions is previously pressed so as to be made wider by $W_{LE}-W_M$ or $W_{TE}-W_M$ on the pressing. Further, $\delta$ and $\Delta W_o$ to be actually measured are empirically represented by the following equation:

$$\delta=\alpha\cdot\Delta W_o \quad (2)$$

In this case, $\alpha$ is a proportionality factor and has a value of 0.8~0.9. When the reduced quantity of width is not more than 350 mm, the value of $\delta$ is 10~40 mm in case of slabs having a narrow width of less than 1,300 mm and 20~70 mm in case of slabs having a width of more than 1,600 mm.

As the width of the slab becomes narrow, the width reduction by the pressing exerts on the widthwise center of the slab, and the sectional shape of the steady portion of the slab approaches to the shapes of the leading end and tail end portions shown in FIG. 5*a*, and consequently, the difference of the width returning quantity between the leading or tail end portion and the steady portion becomes smaller. On the other hand, when the width of the slab is wide, the difference of the width returning quantity becomes larger.

Furthermore, the $\delta$values at the leading and tail ends are substantially the same, which can prevent the width shortage at the leading and tail ends.

The invention will be described with respect to $l_{LE}$ and $l_{TE}$ below. $l_{LE}$ and $l_{TE}$ are distances from the leading and tail ends so that the sectional shape in widthwise direction after the pressing becomes equal to the shape of the steady portion, and are represented by the following equations as functions of slab size and press conditions:

$$\left.\begin{aligned} l_{LE} &= f(H, W, W_M) \\ l_{TE} &= f(H, W, W_M) \end{aligned}\right\} \quad (3)$$

As a result of various experiments of $l_{LE}$ and $l_{TE}$, the values of $l_{LE}$ and $l_{TE}$ are $l_{LE}$=400~1,500 mm and $l_{TE}$=150~1,000 mm in case of narrow width slab and $l_{LE}$=1,000~2,000 mm and $l_{TE}$=700~1,500 mm in case of wide width slab.

Figure 3:
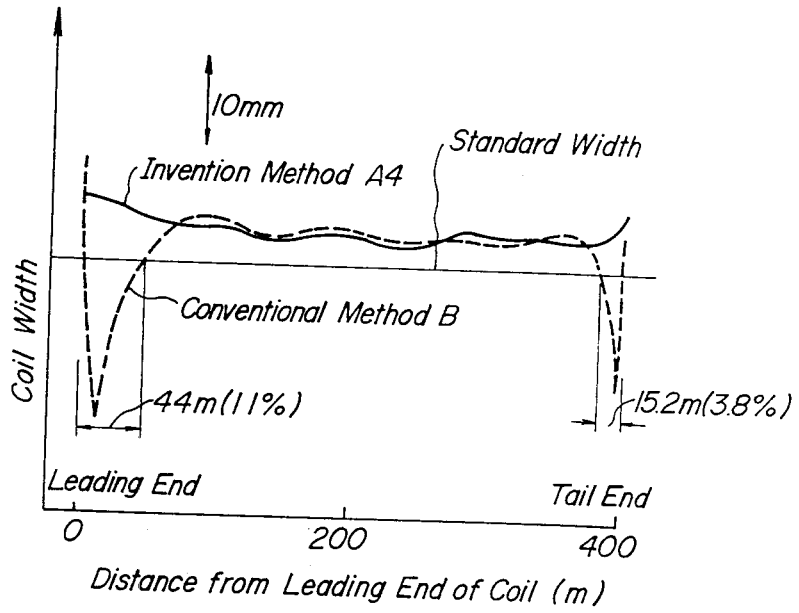
FIG. 3 is a graph showing a longitudinal width distribution of coil produced when subjecting the width reduced slab according to the invention or the prior art to finish rolling.
Figure 7:
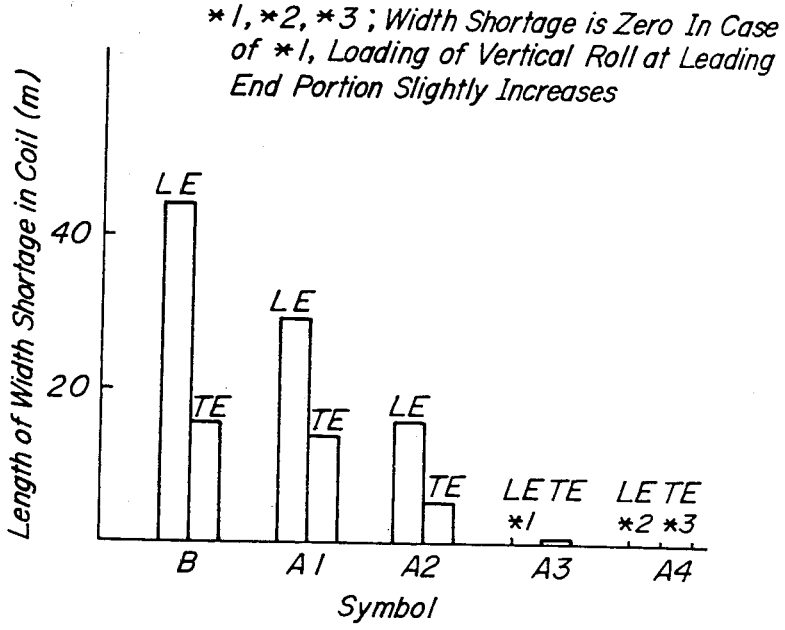
FIG. 7 is a graph showing strip lengths of Width shortage portions at leading end (LE) and tail end (TE) for various slabs whose width reduction conditions are given in Table 1.

As previously mentioned, the shape of FIG. 5*b* approaches to the shape of FIG. 5*a* as the width of the slab becomes narrow. Similarly, the distribution of FIG. 5*a* in the longitudinal direction of the slab becomes short, and consequently, $l_{LE}$ and $l_{TE}$ are made small. On the other hand, as the slab width becomes wider, the shape of FIG. 5*a* is distributed in the longitudinal direction, and consequently, it is required to prolong $l_{LE}$ and $l_{TE}$. As shown in FIGS. 3, 4 and 7, the size and length of width shortage in the tail end portion is small, so that $l_{TE}$ can be made smaller than $l_{LE}$.

Figure 6:
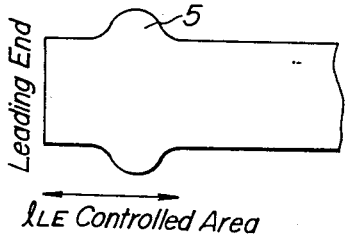
FIG. 6 is a diagrammatic plan view showing a locally widened portion of the slab width produced when $l_{LE}$ is made too large.

When $l_{LE}$ and $l_{TE}$ are too long, locally swelled Wide portion 5 as shown in FIG. 6 is formed in these areas after the flat pass rolling due to the difference of sectional shape as shown in FIG. 5, so that it should take care of enlarging the values of $l_{LE}$ and $l_{TE}$. This swelled wide portion is reduced through vertical roll in the subsequent rough rolling, but if it exceeds the rolling ability of the vertical roll, the swelled portion remains as it is, or the vertical roll may be damaged.

EXAMPLE

The invention will be described with reference to the following example as compared with the conventional method.

A hot steel slab of 215 mm in thickness and 1,600 mm in width as shown in the following Table 1 was successively fed between opposed press tools in a horizontal type press, during which $l_{LE}$, $l_{TE}$, $W_{LE}$ and $W_{TE}$ were changed to reduce the slab in widthwise direction up to a steady portion width of $W_M$=1,430 mm, and then immediately subjected to rolling in rough rolling mills and finish rolling mills to produce a hot strip coil of 2.8 mm in thickness, 1,420 mm in width and 400 m in length.

above lengths are large. The value LE of A3 is a case that $l_{LE}$ is made larger than the value calculated from the equation (3), so that the swelled wide portion is caused at the leading end to increase the loads of vertical roll at an initial stage in the rough rolling, while the swelled wide portion is not caused at delivery side of the rough rolling mills to produce no width shortage of the coil.

As a result, A4 coil produced from the width-adjusted slab A according to the invention can be made into a product over the whole length, while in the conventional material B, the leading and tail end portions are cut out in a total amount of 14.8% as a width shortage to largely reduce the yield.

The lengthwise length and width shortage quantity at leading and tail ends in the conventional method are considerably larger than the width shortage produced in the product reduced in widthwise direction through the vertical rolling mill of the other conventional method, which is a phenomenon inherent to the material reduced in widthwise direction by pressing. Moreover, in the previously mentioned Japanese Patent laid open No. 61-135,402, the portion of 50~100 mm extending from the leading end is widely shaped by pressing in order to reduce the crop loss through a sheet bar, but this portion is cut out before the finish rolling,

TABLE 1

| Method | Symbol | Initial size (mm) | | Slab width after pressing (mm) | | | Length of wide portion after pressing (mm) | | Size of coil | | |
|---|---|---|---|---|---|---|---|---|---|---|---|
| | | Slab thickness | Slab width | $W_{LE}$ Leading end | $W_M$ Steady portion | $W_{TE}$ Tail end | $l_{LE}$ Leading end | $l_{TE}$ Tail end | Thickness (mm) | Width (mm) | Length (mm) |
| Invention method | A1 | 215 | 1,600 | 1,440 | 1,430 | 1,440 | 1,000 | 200 | 2.8 | 1,420 | 400 |
| Invention method | A2 | 215 | 1,600 | 1,450 | 1,430 | 1,450 | 1,000 | 200 | 2.8 | 1,420 | 400 |
| Invention method | A3 | 215 | 1,600 | 1,470 | 1,430 | 1,460 | 1,500 | 200 | 2.8 | 1,420 | 400 |
| Invention method | A4 | 215 | 1,600 | 1,470 | 1,430 | 1,470 | 1,000 | 200 | 2.8 | 1,420 | 400 |
| Conventional method | B | 215 | 1,600 | 1,430 | 1,430 | 1,430 | 0 | 0 | 2.8 | 1,420 | 400 |

Since the value of δ calculated from the equation (2) is 40 mm, the material of symbol A4 in Table 1 has widths $W_{LE}$ and $W_{TE}$ corresponding to a width of 1,470 mm obtained by adding δ to the width of the steady portion, and $l_{LE}$ and $l_{TE}$ thereof are calculated from the equation (3). In A1 and A2, $W_{LE}$ and $W_{TE}$ are smaller than those of A4, while $W_{LE}$ of A3 is the Same as in A4 but $W_{TE}$ is smaller than that of A4. Particularly, the length $l_{LE}$ of wide portion in the leading end portion of A3 is 1.5 times that of A4. On the other hand, in the conventional method, a slab (symbol B) of $W_{LE}=W_M=W_{TE}$=1,430 mm was obtained by successively reducing in widthwise direction under such a condition that the minimum opening is constant from the leading end to the tail end. The width distribution over a whole length from leading end to tail end in the coils A4 and B is shown in FIG. 3. It can be seen from FIG. 3 that there are portions not satisfying the standard width in the leading and tail end portions of the conventional coil, while the width of the material A4 becomes larger than the standard width over the whole length. In FIG. 7 are shown the lengths of leading end (LE) and tail end (TE) portions not reaching the standard width in the materials A1~A4 and B, from which it is obvious that when $W_{LE}$ and $W_{TE}$ are small, the which is related to crop loss in portions outside the leading and tail ends shown in FIG. 3 and is entirely different from the above width shortage through the conventional method.

Thus, the invention has an essential point in that the widths at the leading and tail ends of the slab are made wider in widthwise direction than the steady portion in order to prevent the width shortage of the coil produced by the conventional pressing method over the wide range, so that it is a matter of course that the shaping method is not limited to the successive pressing from the leading end as shown FIG. 2.

In order to prevent the width shortage through the width reduction of the conventional press method, the width over the whole length of the slab may be shaped into a width $W_{LE}$ of wide portion at leading end. In this case, however, the width of the steady portion after the flat pass rolling becomes too wide and the rolling quantity in the rolling through vertical rolling mills at subsequent process becomes large, so that there are problems such as the occurrence of buckling, overloading of the vertical rolling mills and the like. In general, the vertical rolling mills in the rough rolling mill train are small in the size and the thickness is reduced as the rolling proceeds, so that the width-reduced material upheaves in the vicinity of widthwise end and forms a dogborn, which is substantially returned in the width direction at the subsequent horizontal rolling mills and consequently the width of the product coil becomes wider to cause the yield loss. From this point, the length of the wide portion at the leading and tail ends is sufficient to be 2,000 mm. If the length is longer than this value, the swelled wide portion is caused as shown in FIG. 6.

By adopting the reducing of slab in widthwise direction according to the invention, the width shortage produced at leading and tail ends of the width-reduced material can be prevented, so that even if the widths of the continuously cast slabs are unified, it is possible to largely reduce these slabs in widthwise direction by the pressing, which has a very large merit in the production of hot strips owing to the energy-saving and process simplification.

What is claimed is:

1. A method of reducing a slab in the widthwise direction thereof by reducing the width of said slab over a whole length thereof through a pair of press tools periodically approaching to and separating away from each other in the widthwise direction of said slab prior to subsequent flat pass rolling at a hot rolling step of the slab to reduce crop losses at leading end and tail end of said slab, including the step of passing said slab through said pair of press tools to reduce the slab width W in the widthwise direction so that widths $W_{LE}$ and $W_{TE}$, adjacent the leading and tail ends, respectively, of the reduced steady portion $W_M$ of said slab, are made wider by said press tools in the longitudinal direction thereof over a length of 150–2000 mm, which widths $W_{LE}$ and $W_{TE}$ are called as non-steady portions, and controlling the spacing between the press tools to provide predetermined lengths $l_{LE}$ and $l_{TE}$ of said non-steady portions in said leading end and tail end which are wider by a width reducing variation quantity $\delta$ as compared with said steady portion, wherein $\delta = a.\ \Delta W_o$, wherein a is a proportionality factor of 0.8–0.9 and $\Delta W_o = W_o - W_M$, wherein $W_o$ is a width after flat pass rolling and $W_M$ is a width of said slab after the pressing, wherein said lengths $l_{LE}$ and $l_{TE}$ are represented by $l_{LE} = F(H, W, W_M)$ and $l_{TE} = f(H, W, W_M)$, in which H is a slab thickness, W is a slab width and $W_M$ is a slab width of the steady portion after pressing, respectively, wherein 400 mm $\leqq l_{LE} \leqq$ 2000 mm and 150 mm $\leqq l_{TE} \leqq$ 1500 mm, respectively, wherein said $\Delta W_o$ is represented by the following equation: $\Delta W_o = F(H, W, W_M, D, r)$, in which D is a roll diameter in flat pass rolling and r is a reduction ratio in flat pass rolling, and satisfies 10 mm $\leqq \delta \leqq$ 70 mm.

* * * * *